US005546779A

United States Patent [19]

Ginzburg

[11] Patent Number: 5,546,779

[45] Date of Patent: Aug. 20, 1996

[54] INTERSTAND STRIP GAUGE AND PROFILE CONROL

[75] Inventor: Vladimir B. Ginzburg, Pittsburgh, Pa.

[73] Assignees: Danieli United, Inc.; International Rolling Mill Consultants, Inc., both of Pittsburgh, Pa.

[21] Appl. No.: 217,245

[22] Filed: Mar. 24, 1994

[51] Int. Cl.[6] ..... B21B 37/06

[52] U.S. Cl. ..... 72/11.4; 72/234; 72/11.7

[58] Field of Search ..... 72/8–12, 16, 17, 72/21, 20, 234, 200, 365.2, 366.2

[56] References Cited

U.S. PATENT DOCUMENTS

| | | | |
|---|---|---|---|
| 3,169,421 | 2/1965 | Bloodworth | 72/17 |
| 3,170,344 | 2/1965 | Marrs | 72/17 |
| 3,313,125 | 5/1967 | Pullen | 72/17 |
| 3,406,547 | 10/1968 | List | 72/8 |
| 3,566,639 | 3/1971 | Dornbusch | 72/11 |
| 3,782,153 | 1/1974 | Winchester | 72/9 |
| 3,977,223 | 8/1976 | Edwards | 72/17 |

*Primary Examiner*—Lowell A. Larson
*Assistant Examiner*—Thomas C. Schoeffier
*Attorney, Agent, or Firm*—Armstrong, Westerman, Hattori, McLeland & Naughton

[57] ABSTRACT

Method and means for maintaining uniform thickness and profile of a metal strip during hot rolling in a multi-stand hot rolling mill, comprising a two-position looper located between adjacent mill stands and movable between a strip threading position above the rolling pass line of the mill and a rolling position substantially in the plane of the rolling pass line, and a thickness and profile gage movable out of operative relationship with the looper when the looper is in a threading position and into operative relationship with the looper when the looper is in a rolling position, the gage adapted to project a measuring X-ray beam from the thickness and profile gage onto the strip during rolling and at an angle to the strip of substantially 90°, thereby minimizing measurement error due to variable angularity between the X-ray beam and the strip during rolling.

9 Claims, 3 Drawing Sheets

INTERSTAND STRIP GAUGE AND PROFILE CONROL

FIELD OF THE INVENTION

This invention relates to the hot rolling of metal strip and more particularly to means and methods for maintaining the uniformity of strip gauge and profile during hot rolling,

BACKGROUND OF THE INVENTION

To provide good thickness control, as well as good strip profile and flatness control, intermediate feedback signals have to be provided indicative of these parameters as they are measured between mill stands.

In a cold tandem mill, such measurements and feedback control are a common practice.

In hot strip mills, the installation of thickness and profile gages is difficult due to the action of loopers which are a part of the strip interstand tension control mechanism. In the state of the art, as represented, for example, by H. Harakei et al., *Hot Strip Mill Gage Control Using Interstand Thickness Meter*, Iron and Steel Engineer, August, 1992, pages 54–59, special correction for change in angularity of the strip in respect to an X-ray beam is provided. However, such correction cannot be perfect, so it increases an error of measurement, and also makes control more complicated.

The most appropriate position for an intermediate profile gage would be after stand F3 of a 6-stand mill and after stand F4 of a 7-stand mill. This is due to decreased value of allowable changes in relative crown at this point. Therefore, the desired crown-to-thickness ratio (relative strip crown) has to be obtained after those respective stands, as illustrated in FIGS. 1 and 2.

SUMMARY OF THE INVENTION

An objective of this invention is to stabilize the strip position in respect to an X-ray beam projected by a thickness and profile gage and to make an angle between the X-ray beam and the strip surface approach as close as possible to 90°.

To achieve that objective, an interstand tension control is provided with a two-position looper. During threading of the strip between the mill stand rolls, a thickness and profile gage is retracted from the pass line and the looper operates at the height which is optimum for threading. After threading of the strip is completed, the looper is lowered to the rolling position and the thickness and profile gage is moved into operative relationship with the strip to be rolled. See FIGS. 3 and 4.

DESCRIPTION OF PREFERRED EMBODIMENTS OF THE INVENTION

Figure 1:
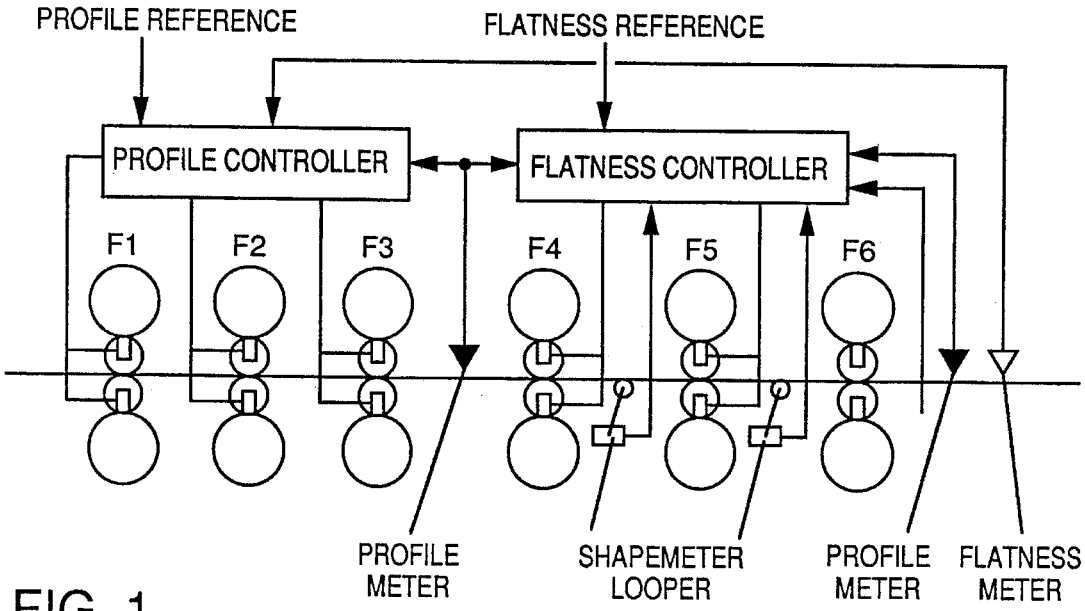
FIG. 1 shows a 6-stand mill in which there is provided means of profile and flatness control and wherein measurement means are located after the F3 stand and the F6 stand.
Figure 2:
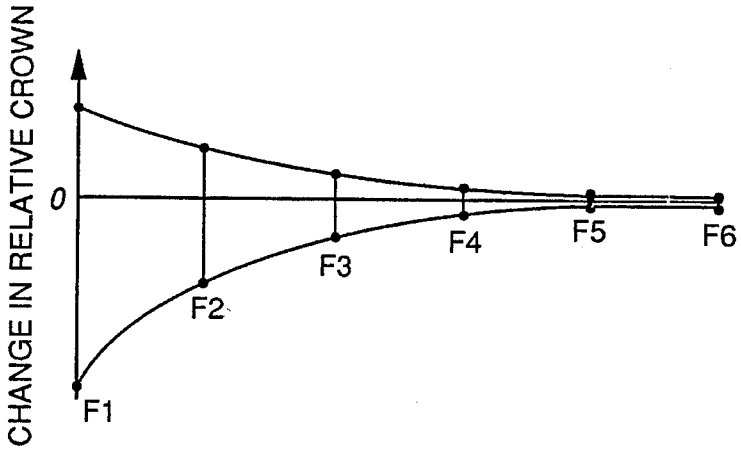
FIG. 2 shows the change in relative crown as the strip passes the respective stands of the 6-stand mill.
Figure 3:
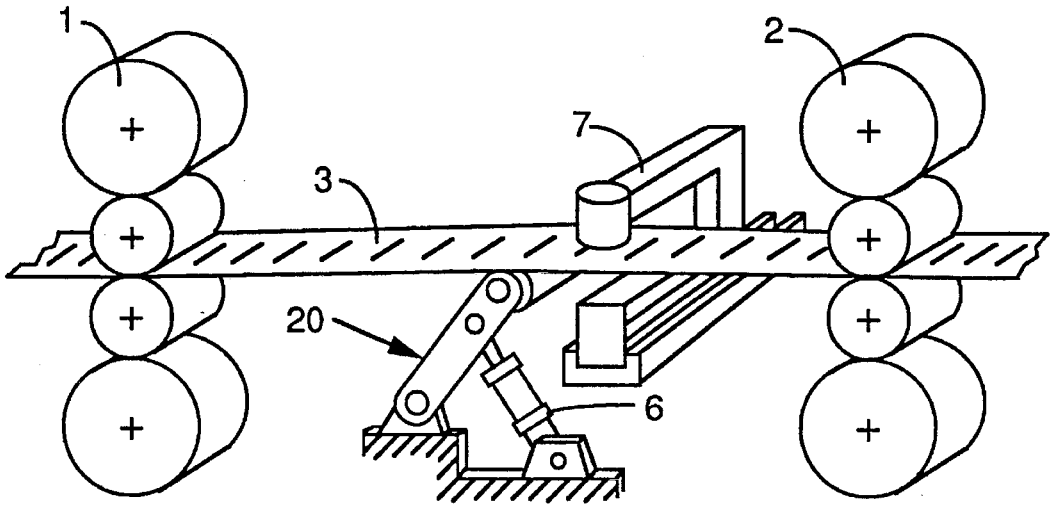
FIG. 3 is a perspective sketch of a pair of mill stands provided with a two-position looper in accordance with the invention.
Figure 4:
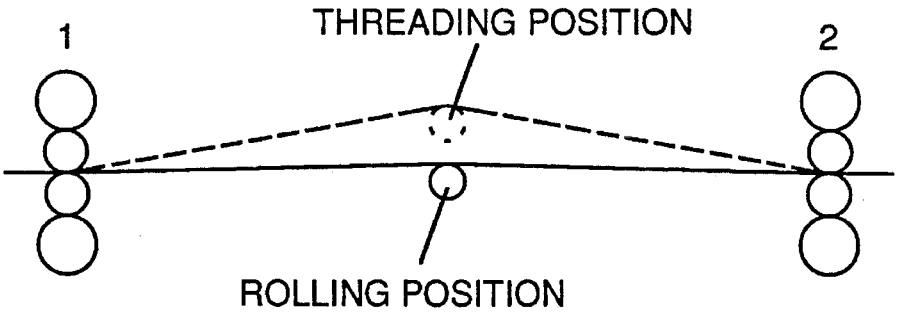
FIG. 4 is an elevational sketch showing the strip (solid line) in rolling position and, in dashed line, in threading position.
Figure 5:
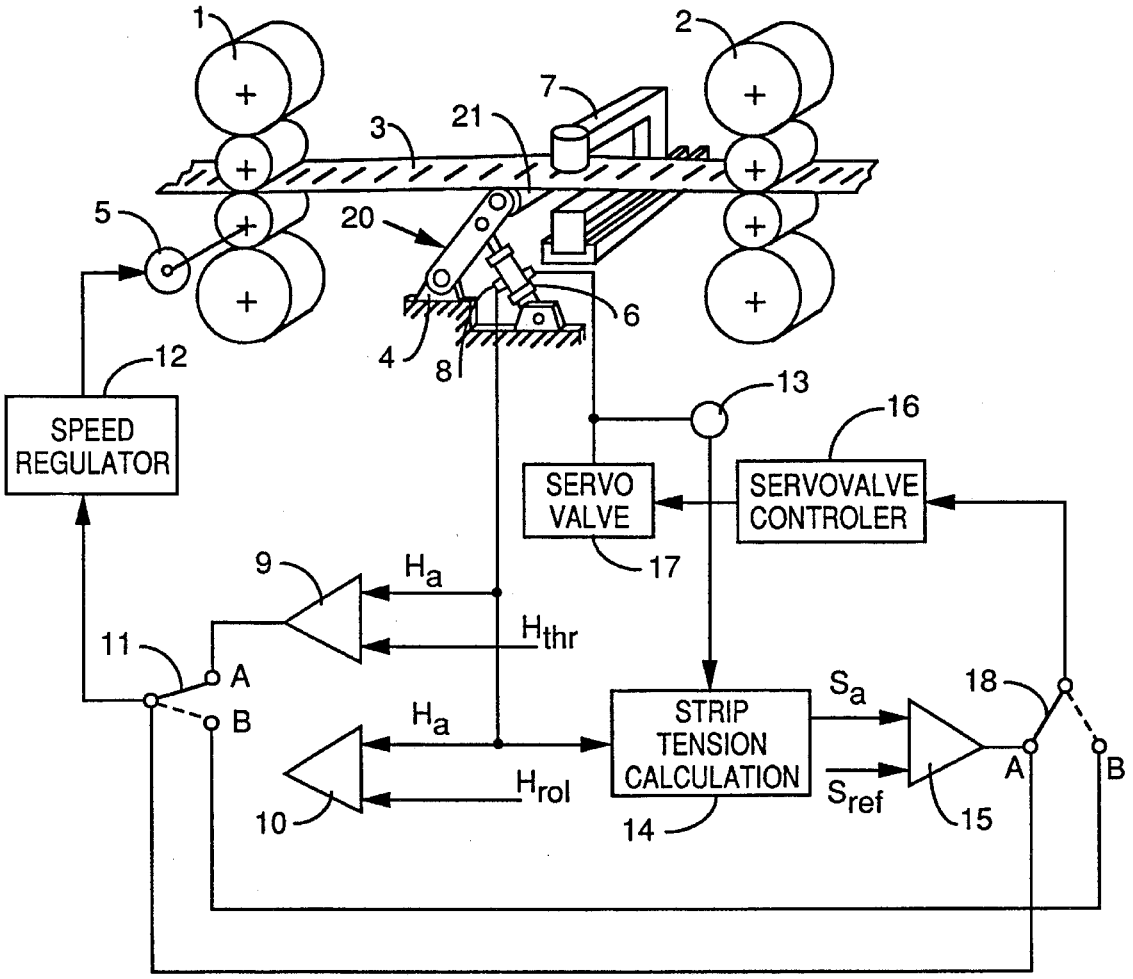
FIG. 5 shows the apparatus of FIG. 3 together with a schematic diagram of the control means therefor.

In FIGS. 3 and 5 a two-position looper is designated generally by the numeral 20, located between two 4-high mill stands 1 and 2, and is effective to raise a strip 3 into a threading position and to lower the strip 3 into a rolling position in operative association with a thickness and profile gage 7. The looper, which includes a roller 21 engageable with the underside of the strip 3, is raised and lowered by means of an hydraulic cylinder/piston assembly 6 and is provided with a position sensor B.

FIG. 5 shows the two-position looper control in a threading position. In this position, switches 11 and 18 are in an "A" position. In such position, threading looper height reference $H_{thr}$ is compared with actual looper position signal $H_a$ generated by position sensor 8 which is connected with looper cylinder 6. After comparison by a position controller 9, the error signal is input into a main drive speed regulator 12 which adjusts mill stand 1 speed in respect to mill stand 2 speed so that a desired looper height is maintained.

At the same time, a strip tension reference $S_{ref}$ is compared with actual strip tension signal $S_a$. An error signal generated by tension regulator 15 is fed into a servovalve controller 16 which regulates oil flow into and out of the hydraulic cylinder 6 through a servovalve 17. Thus a desired strip tension $S_{ref}$ is maintained when the looper 20 is maintained at the desired height $H_{thr}$. The actual strip tension $S_a$ is calculated by the processor 14 based on pressure inside cylinder 6 as measured by a pressure transducer 13 and on actual looper height $H_a$ as measured by position sensor 8.

After threading, switches 11 and 18 are set in the "B" position shown with dotted lines (FIG. 5). In that case, a position controller 10 becomes operative and the rolling looper height reference $H_{rol}$ is compared with actual looper position signal $H_a$. The position error signal generated by the position controller 10 is input into servovalve controller 16 which, through servovalve 17, controls oil flow in and out of the looper cylinder 6. As a result the looper 20 is lowered into the rolling position. At the same time, speed regulator 12 is fed by a strip tension error signal generated by tension regulator 15, so a desired strip tension is maintained while the looper is set at the elevation which is optimum for strip profile control.

By such means, the position of the thickness and profile gage 7 is maintained at essentially a 90° angle to the strip 3 during rolling thereby minimizing measurement errors due to variable angularity between the X-ray beam of the thickness and profile gage 7 and the strip.

What is claimed is:

1. Apparatus for controlling the thickness and profile of a metal strip during hot rolling in a multi-stand hot rolling mill, comprising a looper operable in adjustable height and constant height modes located between two adjacent mill stands and movable between (a) a strip threading position in which the looper height is adjusted for providing constant strip tension during threading above a rolling pass line of the mill and (b) a rolling position in which the looper height is maintained constant with the strip substantially in the rolling pass line at an elevation optimum for strip profile control and in which position a desired strip tension is maintained, means to adjust the looper height in the strip threading position, means to control the looper at a constant height in a rolling position, and a thickness and profile gage adjacent the looper and including means to project an X-ray beam onto the strip during rolling of the strip, said thickness and profile gage being in operative association with the strip when the looper is in the lowered, rolling position and the means to hold the strip at a constant height during rolling is effective to maintain the strip at an angle of substantially 90° to the X-ray beam during rolling of the strip, thereby minimizing measurement errors due to variable angularity between the X-ray beam and the strip.

2. Apparatus according to claim 1, wherein the looper comprises a roller engageable with the underside of the strip being rolled, and an hydraulic cylinder/piston assembly to raise and lower the roller.

3. Apparatus according to claim 2, wherein the apparatus further includes position sensor means to sense the height of the looper and pressure sensor means to sense the pressure inside the hydraulic cylinder/piston assembly.

4. Apparatus according to claim 3, wherein the apparatus further includes means to compare a desired looper height reference with an actual looper position signal generated by the position sensor means and to generate a first error signal, a main mill drive speed regulator, means to input the first error signal into the main drive speed regulator to adjust the speed of a first mill stand next upstream of the looper to the speed of a second mill stand next downstream of the looper.

5. Apparatus according to claim 4, wherein the apparatus further includes means to generate a strip tension reference signal and an actual strip tension signal and to compare said signals and to generate a second error signal, means responsive to said second error signal to control the flow of hydraulic fluid into and out of the hydraulic cylinder/piston assembly and thereby to maintain a desired strip tension when the looper is maintained at a desired height above the rolling pass line of the mill.

6. Apparatus according to claim 3, wherein, in rolling position of the looper, the apparatus further comprises a mill stand speed regulator for regulating the speed of mill stands next upstream and next downstream of the looper, a servovalve and servovalve controller to control pressure within the hydraulic cylinder/piston assembly, means to generate a strip tension error signal from a comparison of a desired strip tension and an actual strip tension, means to generate a looper position error signal from a comparison of a desired looper height and an actual looper height, means to feed the first error signal to the speed regulator, and means to feed the second error signal to the servocontroller, whereby the looper is maintained at a desired constant height substantially in the rolling pass line of the mill and at an elevation optimum for strip profile control.

7. A method of controlling the thickness and profile of a metal strip during hot rolling in a multi-stand hot rolling mill provided with a looper disposed between two adjacent mill stands and operable in an adjustable height mode and a constant height mode, comprising threading metal strip into the mill stands while adjusting the looper height above a rolling pass line of the mill and thereby maintaining constant strip tension in the threading position of the strip, and, after threading is completed, lowering the looper into a position substantially in the rolling pass line of the mill at an elevation optimum for strip profile control, moving a thickness and profile gage into operative relationship to the looper in the lowered position, projecting an X-ray beam from the thickness and profile gage onto the strip during rolling and maintaining the looper height substantially constant in such lowered position whereby the strip is maintained at an angle of substantially 90° to the X-ray beam, thereby minimizing measurement errors due to variable angularity between the strip and the X-ray beam.

8. A method according to claim 7, wherein, in a threading position of the looper, a looper height reference signal is compared with an actual looper position signal generated by a position sensor connected to a looper raising and lowering means and generating a first error signal, inputting the first error signal into a main mill drive speed regulator, adjusting the speed of a mill stand next upstream of the looper in respect to the speed of a mill stand next downstream of the looper, generating a strip tension reference signal and an actual strip tension signal and comparing said signals to generate a second error signal therefrom, inputting the second error signal into a servovalve contraoller and thereby controlling the pressure of hydraulic fluid in a hydraulic cylinder adapted to raise or lower the looper, and thereby adjusting the height of the looper above a rolling pass line of the mill and thereby maintaining a desired strip tension during threading.

9. A method according to claim 7, wherein, in a rolling position of the looper, the method comprises comparing a desired strip tension signal and an actual strip tension signal, generating therefrom a strip tension error signal, inputting said strip tension error signal into a mill drive speed regulator and thereby adjusting mill drive speed, comparing a desired looper position signal and an actual looper position signal and generating therefrom a looper position error signal, inputting said looper position error signal into a servovalve controller controlling looper position, whereby desired strip tension is maintained and the looper is maintained at a constant height at an elevation optimum for strip profile control substantially in the rolling pass line of the mill and in operative relationship to a thickness and profile gage, and projecting an X-ray beam from said gage onto the strip being rolled, whereby the strip is maintained at an angle of substantially 90° to the X-ray beam.

* * * * *

UNITED STATES PATENT OFFICE

CERTIFICATE OF CORRECTION

PATENT NO. : 5,546,779

DATED : Aug. 20, 1996

INVENTOR(S) : Vladimir B. Ginzburg

It is certified that error appears in the above-identified patent and that said Letters Patent is hereby corrected as shown below:

On the title page, Title should read

INTERSTAND STRIP GAUGE AND PROFILE CONTROL

Signed and Sealed this

Twelfth Day of November, 1996

*Attest:*

Bruce Lehman

BRUCE LEHMAN

*Attesting Officer*

*Commissioner of Patents and Trademarks*